United States Patent [19]

Jacobi

[11] 4,121,318

[45] Oct. 24, 1978

[54] TEXTILE MACHINE CLEANING SYSTEM

[75] Inventor: Ernst Jacobi, Friedberg, Fed. Rep. of Germany

[73] Assignee: Ernst Jacobi & Co. KG, Augsburg, Fed. Rep. of Germany

[21] Appl. No.: 684,375

[22] Filed: May 7, 1976

[30] Foreign Application Priority Data

May 7, 1975 [DE] Fed. Rep. of Germany ..... 2520306
Jun. 5, 1975 [DE] Fed. Rep. of Germany ..... 2525083

[51] Int. Cl.[2] ..... B08B 5/00
[52] U.S. Cl. ..... 15/312 A
[58] Field of Search ..... 15/312 R, 312 A, 316

[56] References Cited

U.S. PATENT DOCUMENTS

| | | | |
|---|---|---|---|
| 1,781,142 | 11/1930 | Walker | 15/312 R |
| 1,920,768 | 8/1933 | Smith | 15/312 R |
| 2,063,816 | 12/1936 | Linder | 15/312 R |
| 3,440,097 | 4/1969 | Gleaton | 15/312 R X |

*Primary Examiner*—Christopher K. Moore
*Attorney, Agent, or Firm*—C. Emmett Pugh & Associates

[57] ABSTRACT

A textile-machine cleaning device, having a cleaning hose and adapted to generally move overhead of a textile machine, is provided with means whereby the hose can be moved automatically from a first position in which it is operative to clean said machine, and a second position in which it allows the unimpeded passage of a further device (e.g. a yarn-attaching machine) servicing said textile machine and moving in the same path of movement as the hose. Conveniently, the cleaning device operates in combination with said further device, which is provided with means coacting with said means for moving the hose so as to cause said hose to adopt one of said two positions. Seven embodiments are described and illustrated.

8 Claims, 7 Drawing Figures

TEXTILE MACHINE CLEANING SYSTEM

BACKGROUND OF THE INVENTION

1. Field of the Invention

The present invention relates to a cleaning device for cleaning textile machines, said device being arranged for movement along the machine and having an overhead air-blowing arrangement provided with air connections, to which connections at least one vertically disposed air hose with openings directed on to the machine is connected.

2. Prior Art

Known cleaning devices for cleaning textile machines are normally provided with a blower housing designed to travel on rails above the textile machines. Extending from the housing on either side of the textile machine are normally two vertically disposed air hoses, one hose being used as a blower and the other as a suction hose in order to suck away the yarn flick. In this way several textile machines arranged one after the other, to form a bank or a row of machines, can be cleaned using one and the same device.

When the textile machines concerned are spinning machines, a yarn-attaching machine is provided for each spinning machine, which yard-attaching machine travels along the two sides of the bank of textile machines. This yarn-attaching machine projects out of the side zones of the textile machines.

It is well-known to arrange the hoses of the cleaning device at such an interval from the sides of the textile machines that no change between air hose and the yarn-attaching machine can occur. The space between the air hoses and each side of the textile machine, however, is then so large as to adversely affect the cleaning efficiency of the device. Again, frequently, the mutual space between the textile machines is insufficient to allow the hoses to be arranged in the indicated manner.

To avoid these disadvantages, it is well-known to connect the cleaning device to the yarn-attaching machine, so as to obtain a single traversing unit. This solution, however, has the disadvantage that the cleaning device can then only clean on one side of the textile machine, which results in a not inconsiderable increase in investment costs.

As will be apparent from the aforegoing, there is a need for a textile machine cleaning device which can traverse a textile machine or a bank of such machines independently of the yarn-attaching machine or of any other textile machine servicing apparatus, which will not impede the passage of said yarn-attaching machine or said apparatus along said machine or bank of machines, and which will efficiently clean said textile machines.

3. General Discussion of Present Invention

Accordingly, this invention consists in a textile machine cleaning device which is movable along a textile machine and which has at least one air hose, wherein said device comprises hose-moving means for automatically moving said air hose between a first position in which it is operative to effect cleaning of said textile machine and a second position in which it permits the unimpeded passage of any further device moving along said textile machine in the movement path of said cleaning device.

BRIEF DESCRIPTION OF DRAWINGS

So that the invention will be more readily understood and further features thereof made apparent, exemplary embodiments of the invention will now be described with reference to the accompanying drawings, in which.

DETAILED DESCRIPTION OF PREFERRED EMBODIMENTS

Figure 1:
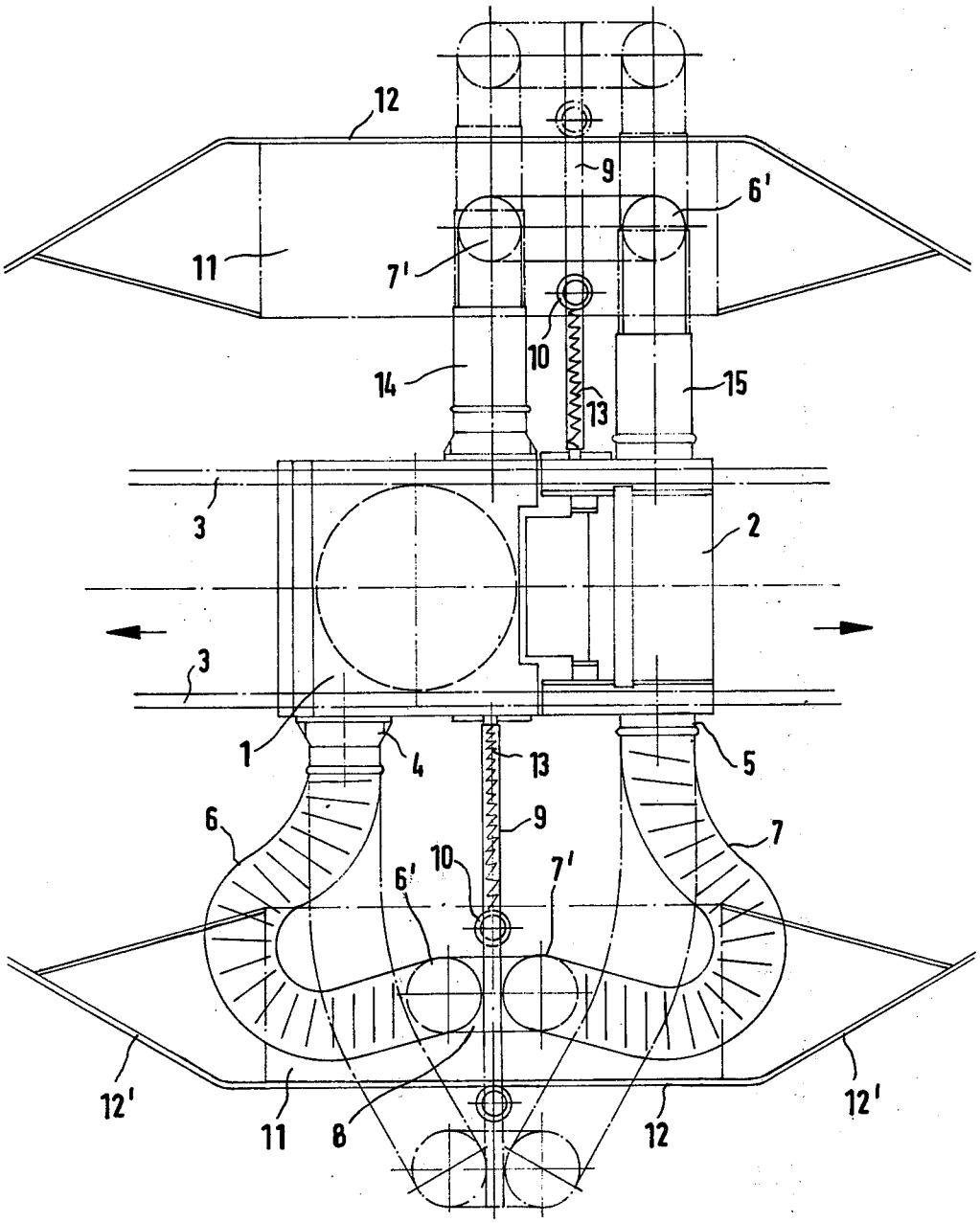
FIG. 1 is a diagrammatic plan view of first and second embodiments of the cleaning device.

The cleaning device of FIG. 1 comprises a blower housing with a filter chamber 2 arranged to move backwards and forwards on the support structure 3 textile machine to be cleaned. The housing 1 is provided with air connections 4, 5, a blower hose 6 being connected to the connection 4 and a suction hose 7 to the connection 5.

In the embodiment shown in the bottom half of FIG. 1, the hose section between the air connections 4, 5 and substantially vertically extending parts 6', 7' of each air hose, is flexible, and preferably corrugated. The top parts of the substantially vertically extending hose sections 6', 7' are supported by a supporting and fixing device 8. The supporting and fixing device is assembled on an outwardly-projecting guide rail 9 which is preferably telescopic. The supporting and fixing device 8 carries a downwardly-projecting arm provided at its end with a guide roller 10. To a yarn-attaching device 11, there is attached a rail 12 having an entry ramp 12' at both ends thereof.

Normally, the hoses 6, 7 or the vertical hose sections 6', 7' have the position shown in FIG. 1 in full lines. However, as the cleaning device and yarn-attaching machine approach each other, the roller 10 will come into contact with one of the entry ramps 12' and this, in association with the roller 10, guides the supporting and fixing device 8 and with it the vertically extending hose sections 6', 7' outwards to the position shown in chain-dotted line. When the hoses 6, 7 are moved outwards, a spring 13 preferably arranged in the telescopic tube 9, is tensioned. The hoses 6, 7 are returned to their operative cleaning position when they have moved out of the area occupied by the yarn-attaching machine 11, i.e. when the roller 10 moves down the other ramp 12', by the action of said spring.

In the embodiment shown in the top half of FIG. 1, instead of the flexible hose sections, the air connections 14, 15 are in the form of telescopic ducts to whose forward ends the vertically extending hoses 6', 7' are connected. These telescopic ducts are extended when the roller 10 comes into contact with the rail 12. The mode of operation of this embodiment is identical to that of the embodiment shown in the bottom half of FIG. 1.

The cleaning device and the yarn-attaching machine may move towards one another during operation, or the cleaning device may overtake the yarn-attaching machine, because normally the speed of motion of the cleaning device is three times that of said machine.

Figure 2:
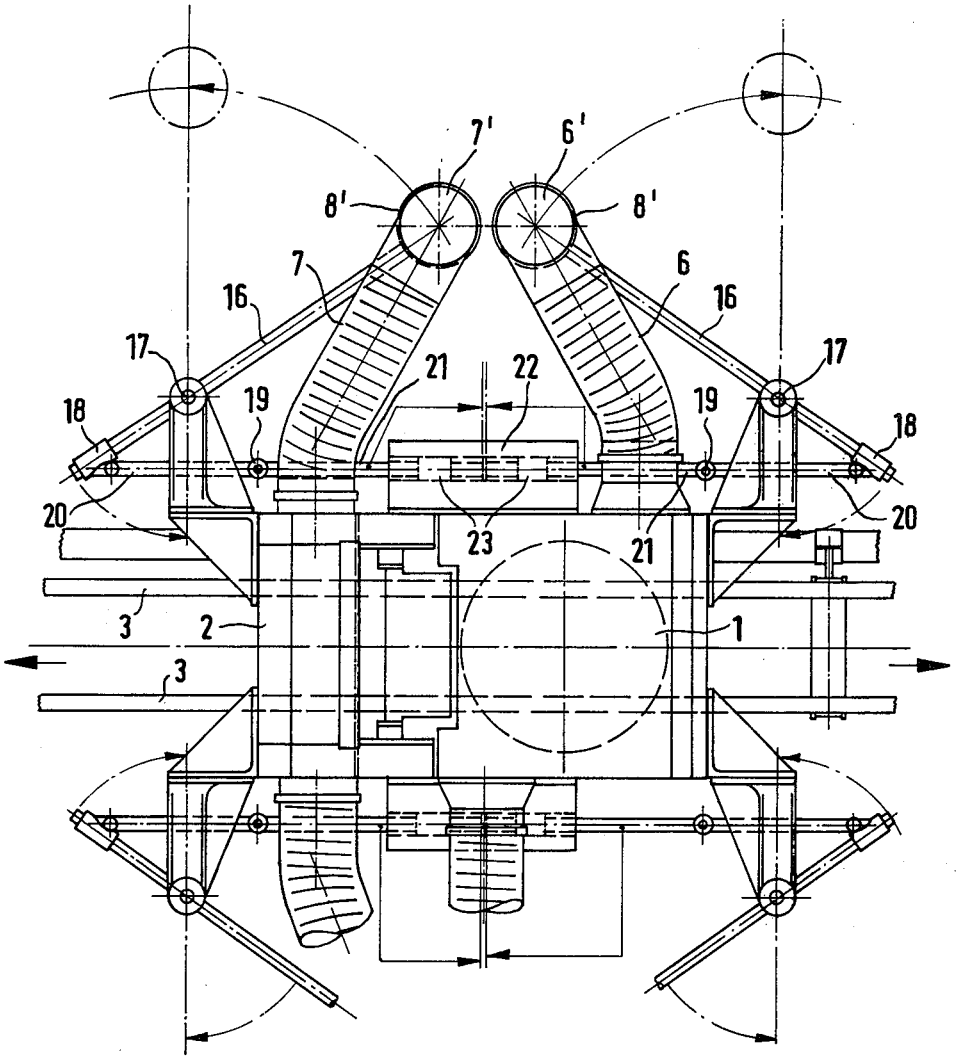
FIG. 2 is a diagrammatic plan view of a third embodiment.

In the embodiment shown in FIG. 2, the supporting and fixing device 8' of respective hoses 6, 7 is attached to one end of an arm 16 forming part of a triangular linkage 16, 20. The arm 16 is pivotally mounted at 17 to the blower housing 1 and filter casing 2. The other end of the arm 16 is articulated through a joint 18 to an arm 20 which is in turn articulated through a joint 19 to a threaded spindle 21. The spindle 21 is moved by a rotating spindle-nut 23, the nut 23 being powered by a motor 22.

A switch (not shown in the drawing) is provided which upon contact between the hoses and a yarn-attaching machine supplies a signal to the motor 22 causing the same to be energized. The nut 23 is then caused to rotate to effectively shorten the spindle 21 in the direction of the motor 22, so that the joints 18 execute a motion indicated by the circular arrows. Consequently, the arms 16 are pivoted outwardly and the hose sections 6', 7' describe a motion indicated by the circular arrows. As a consequence, the hose sections 6', 7' pivot outwardly and out of the path of the yarn-attaching machine. As soon as the cleaning device has moved out of the region occupied by the yarn-attaching machine, a further switch is activated which causes the motor 22 to rotate in the reverse direction, so that the hoses pivot inwardly.

The motor 22 in the indicated example is an electric motor. However, the motion can also be produced by a hydraulic or pneumatic motor and this also includes motors of piston type. The only requirement is that the motor should be capable of displacing the joint 19 parallel to the path of motion of the cleaning device. Within the framework of this concept, it is also possible for the piston of a piston-and-cylinder arrangement to act directly with its piston rod on the supporting and fixing device 8 or 8' and to move the hoses out and back without the use of any intermediate kinematic chain elements. Cylinder and piston will in this context preferably be disposed at right angles to the path of motion of the cleaning device.

Figure 3:
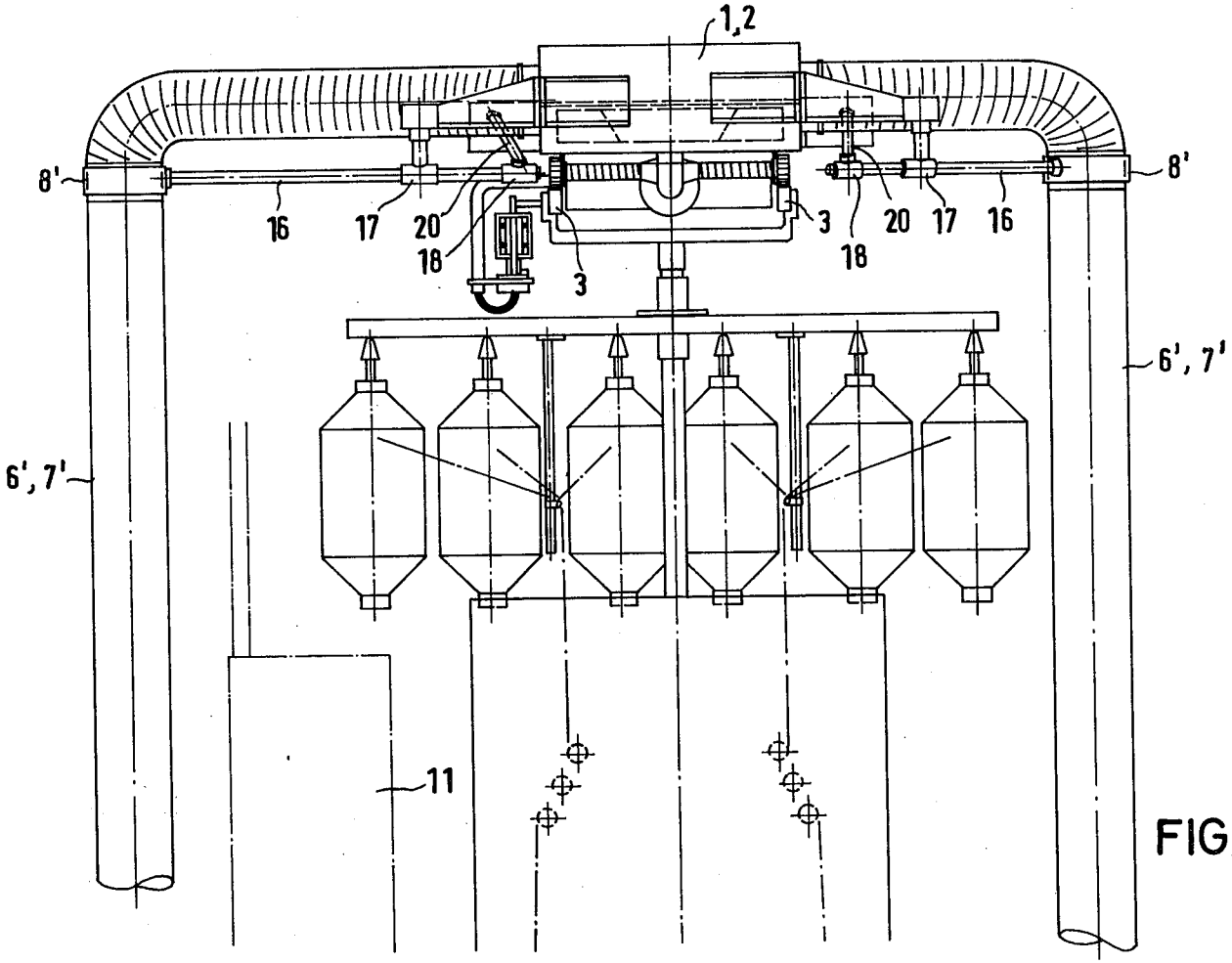
FIG. 3 is a side elevation of the embodiment of FIG. 2.

FIG. 3 is a side elevation of the cleaning device of FIG. 2. The right-hand half of FIG. 2 illustrates the hose position during a cleaning operation and the left-hand half illustrates the hose position when the cleaning device is in the zone of the yarn-attaching machine 11.

The aforementioned switches may be mechanically or photoelectrically operated switches. Also, pressure switches are conceivable, these responding when the air flow from the blower hose 6' strikes them.

Figure 4:
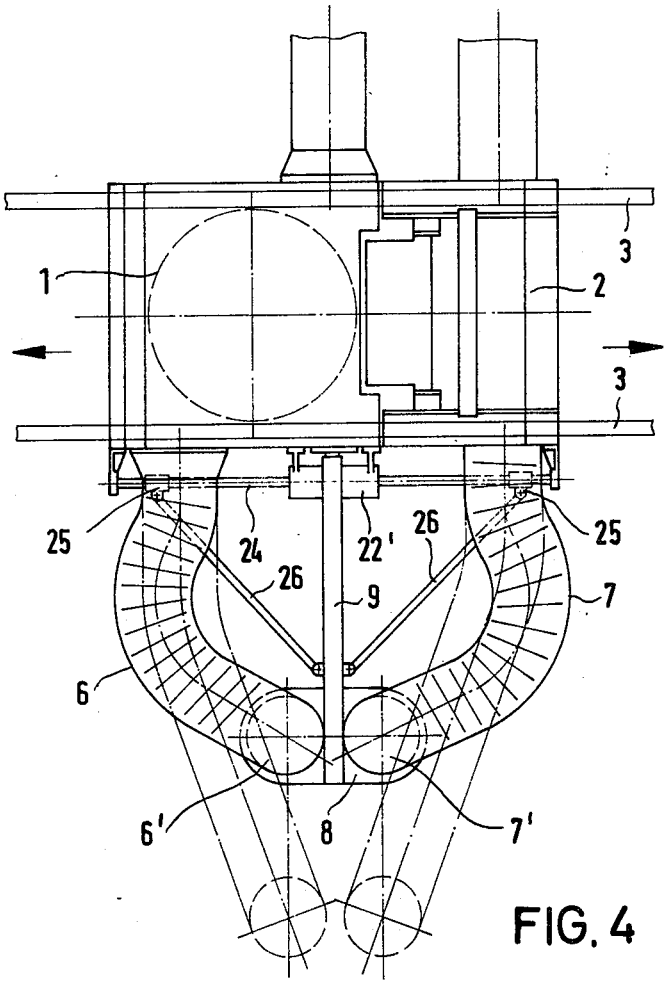
FIG. 4 is a diagrammatic plan view of a fourth embodiment.

In the embodiment of FIG. 4, the hoses 6, 7 are supported by a common supporting and fixing device 8 which is in turn mounted on a telescopic guide rail 9. The motor 22' is arranged to rotate a threaded spindle 24 on which two threaded sleeves 25 are mounted. Between the two threaded sleeves 25 and the supporting and fixing device 8, in each case an obliquely disposed leader arm 26 is arranged. When the motor 22' rotates the threaded spindle 24, the two sleeves 25 move towards each other so that through the two lever arms 26 the supporting and fixing device 8, complete with hoses 6, 7, is moved outwards. With rotation of the spindle 24 in the opposite direction, the hoses are moved back. The motor 22' is actuated by the aforementioned switches.

Figure 5:
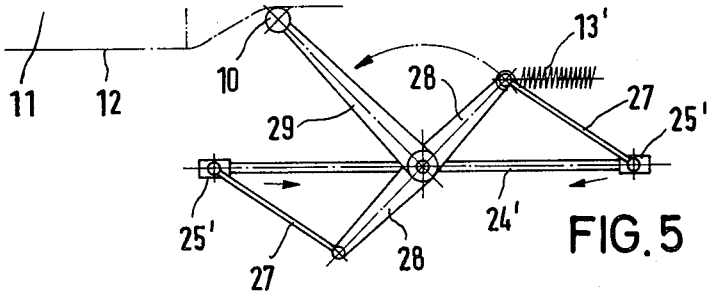
FIG. 5 shows diagrammatically a fifth embodiment.

In the embodiment of FIG. 5, instead of the threaded sleeves 25 of FIG. 4, sliding sleeves 25' are provided which can slide on the rod 24'. The sliding motion on the part of the sleeves 25' is produced by triangular linkages 27, 28, the link 28 being centrally arranged and exhibiting a lever arm 29 to which a roller 10 is attached. When the roller 10 contacts with rail 12, the two sleeves 25' are moved towards each other. The return motion is produced by a spring 13'. Articulated to each of the sliding sleeves 25' is a lever arm (not illustrated) corresponding to the lever arm 26 of the FIG. 4 embodiment, and the displacement of the hoses in the outward and inward directions takes place in the same way as described in relation to FIG. 4.

Figure 6:
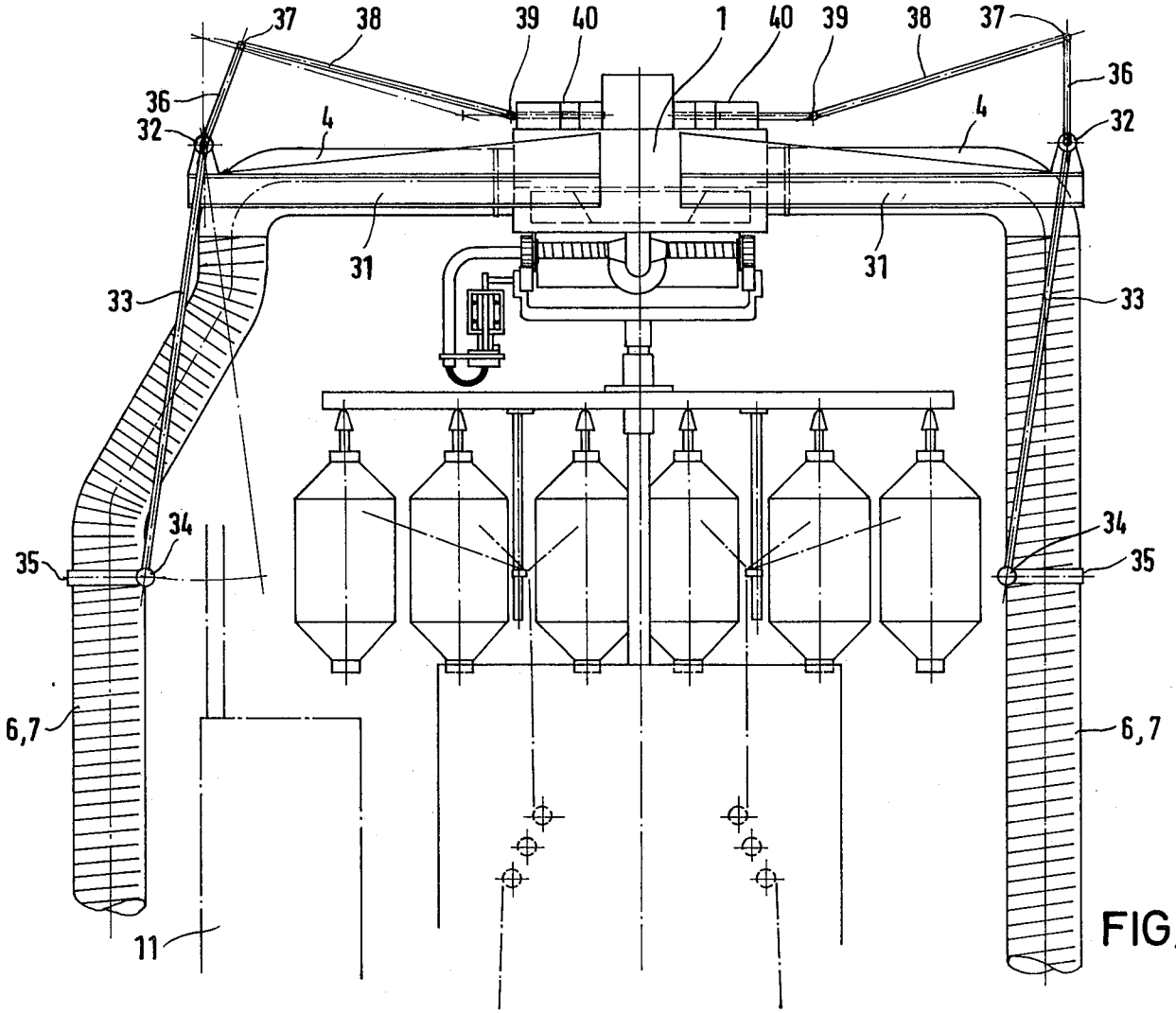
FIG. 6 shows diagrammatically a sixth embodiment; on the right-hand side of the figure the air hose is shown in its operative, cleaning position and on the left-hand side is shown in the position it occupies in the neighbourhood of the yarn-attaching machine.

In the example shown in FIG. 6, the air hoses 6, 7 are designed as corrugated hoses, i.e. are resilient.

Connected to the blower housing 1 is a horizontal supporting arm 31 at whose outer end there is a joint 32 through which a lever arm 33 is articulated. The lever arm 33 is attached to the joint 34 through a hose clip 35. The hose clip and the joint 34 are located above the path of motion of the yarn-attaching machine 11. The lever arm 33 has an extension 36 to which, through the joint 37, the actuating arm 38 is articulated. The other end of the actuating arm 38 is connected at 39 to a servo-motor 40 arranged above the blower housing 1.

As the hose 6, 7 moves into the proximity of the yarn-attaching machine 11, the motor 40 is so operated that the arm 38 moves inwardly so that the hose 6, 7 is moved outwardly beneath the clip 35, outside the path of motion of the yarn-attaching machine. When the hose 6, 7 has moved out of the zone of the yarn-attaching machine 11, the motor 40 is actuated in the opposite direction so that the hose returns to its normal position as shown in the right-hand half of the drawing.

Figure 7:
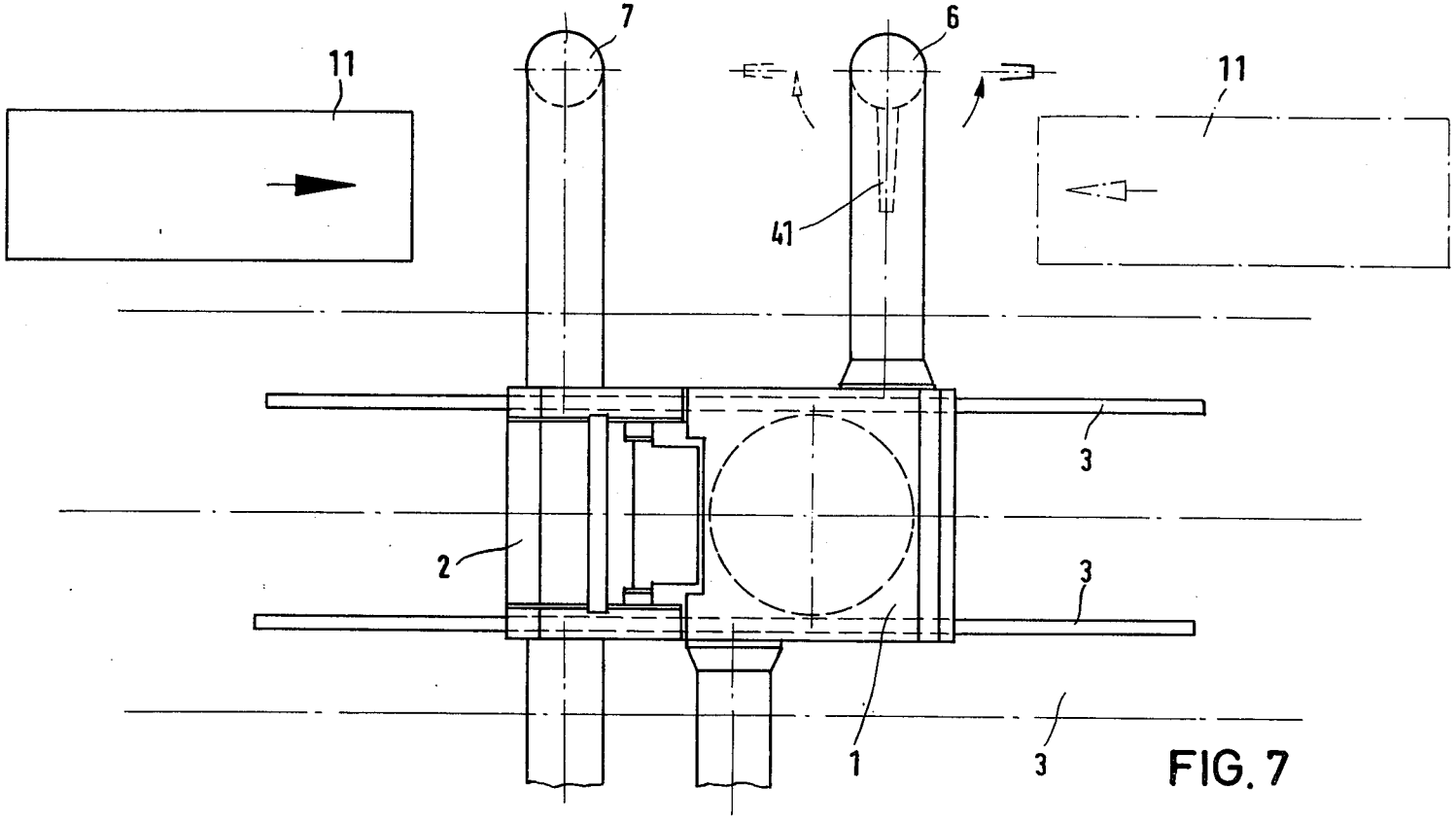
FIG. 7 is a diagrammatic plan view of a seventh embodiment of a cleaning device according to the invention.

In the embodiment of FIG. 7, the two hoses 6, 7 are shown to be moved outwards to such an extent that their path of motion does not overlap that of the yarn-attaching machine 11. The blower hose 6 is provided with several nozzles 41 directed towards the textile machine. The path of motion of these nozzles 41 overlaps that of the yarn-attaching machine 11. The blower hose is provided at its top region with a swivel joint which has not been shown.

When the cleaning device moves into a area occupied by the yarn-attaching machine 11, the hose section carrying the nozzles 41 is pivoted through 90° so that the nozzles 41 move out of the path of motion of the yarn-attaching machine 11. The hose section carrying the nozzles 41 is rotated in opposition to the relative motion between the claning device and the yarn-attaching machine 11, i.e. the nozzles 41 always pivot away from the yarn-attaching machine 11. This is indicated in the drawing by the arrows.

The rotary motion can be produced quite simply by a lever arranged on the rotatable hose section and adapted to come into contact with part of the yarn-attaching machine. When the hose 6 moves out of the zone of the yarn-attaching machine 11, the rotatable hose section rotates back to its normal position this being produced quite simply by one of two springs which are arranged on the rotatable hose section, and which act in opposite direction and restore the normal position of the nozzles 41.

The described and illustrated embodiments, although preferred, are exemplary and generally should not be considered restrictive, and the invention can be modified in many ways within the scope of the inventive concept.

What I claim as my invention and desire to secure by Letters Patent of the United States is:

1. A textile cleaning device which is movable along a textile machine in combination with a yarn-attachment device which is arranged for movement along the textile machine, wherein said cleaning device comprises:

at least one air hose;

a hose-supporting device;

a blower housing with which one end of the hose is in fluid communication, wherein said hose at least partially overlaps the movement path of the yarn-attachment device, and wherein a portion of said hose is attached to said hose-supporting device, said hose-supporting device having actuator means arranged to cooperate with cooperating means on the yarn-attachment device for moving the hose between a first position in which it is operative to effect cleaning of said textile machine and a second position in which it permits the unimpeded passage of said yarn-attachment device.

2. A cleaning device as claimed in claim 1, wherein said actuator means comprises an extensible arm, a tension spring which is tensioned as said arm is extended, and a roller mounted on one end of the arm, said roller being arranged to engage ramp means on the yarn-attachment device so as to extend and collapse said extensible arm.

3. A cleaning device as claimed in claim 1, wherein said actuator means comprises a first arm which is pivotally mounted to the blower housing at a point spaced from one end of said arm and which is attached to said hose supporting device at the other end thereof, a second arm which is pivotally mounted to said one end, a screw-threaded spindle articulated to said second arm, a spindle nut arranged on said spindle and operative to rotate the same, and a motor which is arranged to be energized by said cooperating means on the yarn-attachment device so as to rotate said nut upon contact of the yarn-attachment device with said hose, thereby to cause the arms to move said hose to and from said first and second positions.

4. A cleaning device as claimed in claim 3, wherein said motor is arranged to displace the articulated joint between said second arm and said spindle in a direction parallel to the movement path of the cleaning device.

5. A cleaning device as claimed in claim 1 wherein at least the part of the hose adjacent the hose-supporting device is flexible.

6. A cleaning device as claimed in claim 3 wherein said motor is an electric motor.

7. A cleaning device as claimed in claim 5, wherein at least a portion of said hose is corrugated.

8. A cleaning device as claimed in claim 2 wherein the part of the hose adjacent the hose supporting device comprises sections which are telescopically received one within another.

* * * * *